US005664294A

United States Patent [19]

Sorensen et al.

[11] Patent Number: 5,664,294

[45] Date of Patent: Sep. 9, 1997

[54] CABLE TIE HAVING ENHANCED LOCKING ENGAGEMENT BETWEEN TEETH ON ABUTMENT WALL AND RATCHET TEETH ON TONGUE

[76] Inventors: Soren Christian Sorensen, P.O. Box 256 North Side; Jens Ole Sorensen, P.O. Box 221, North Side, both of Grand Cayman, Cayman Islands

[21] Appl. No.: 580,653

[22] Filed: Dec. 29, 1995

[51] Int. Cl.[6] ..... B65D 63/00

[52] U.S. Cl. ..... 24/16 PB; 24/17 AP; 24/30.5 P

[58] Field of Search ..... 24/16 PB, 17 AP, 24/17 A, 17 B, 17 R, 30.5 P

[56] References Cited

U.S. PATENT DOCUMENTS

| | | | |
|---|---|---|---|
| 3,924,299 | 12/1975 | McCormick | 24/16 PB |
| 4,097,966 | 7/1978 | Lefnaer | 24/16 PB |
| 4,473,524 | 9/1984 | Paradis | 264/291 |
| 4,502,187 | 3/1985 | Kitagawa | 24/17 AP |
| 4,658,478 | 4/1987 | Paradis | 24/16 PB |
| 5,146,654 | 9/1992 | Caveney et al. | 24/16 PB |
| 5,389,330 | 2/1995 | Sorensen et al. | 264/328.1 |

FOREIGN PATENT DOCUMENTS

| | | | |
|---|---|---|---|
| 2556411 | 6/1977 | Germany | 24/16 PB |
| 2145150 | 3/1985 | United Kingdom . | |

*Primary Examiner*—Victor N. Sakran

[57] ABSTRACT

In a tie including an elongated tongue and a locking head having a movable pawl that is hinged at one side of an opening in the locking head across the opening from an abutment surface for, locking engagement with a first set of ratchet teeth on one broad side of the tongue when the tip of the tongue has been inserted through the opening and teeth on the abutment surface for locking engagement with a second set of ratchet teeth on the other broad side of the tongue when the tip of the tongue has been inserted through the opening, locking engagement is enhanced by the locking surface of at least one abutment surface tooth extending toward the apex of such tooth at an angle inclined toward the direction of insertion for locking engagement with a tooth of the second set of ratchet teeth; and by the locking surface of at least one of the second set of ratchet teeth extending toward the apex of such tooth at an angle inclined away from the direction of insertion for locking engagement with an abutment surface tooth.

4 Claims, 1 Drawing Sheet

FIG.1
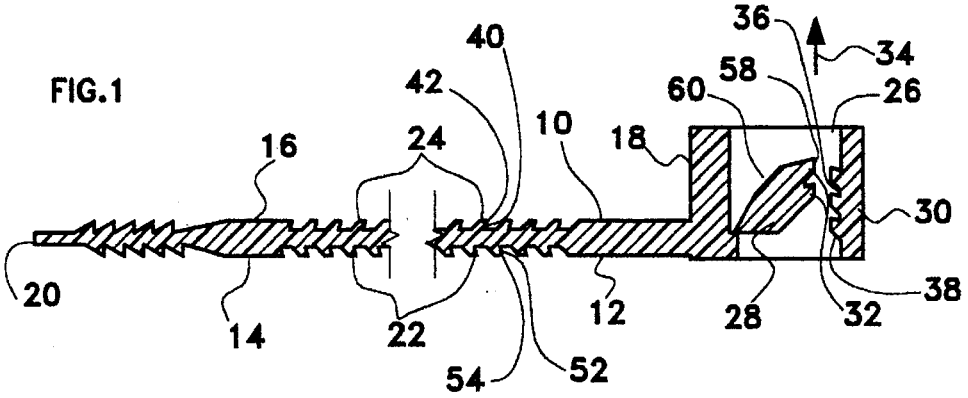
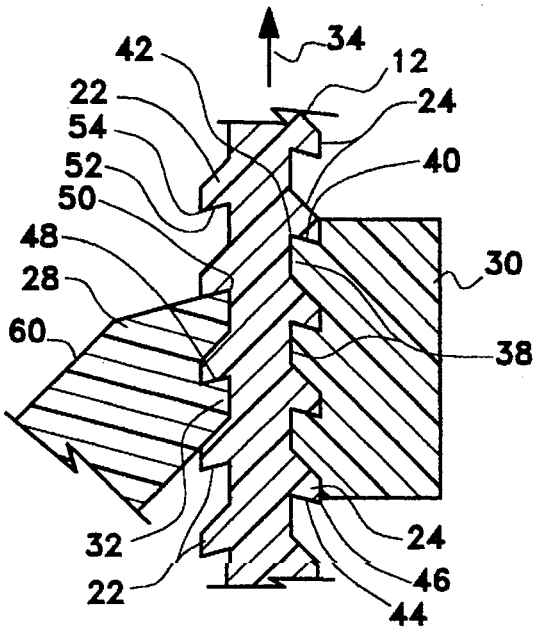
FIG.2
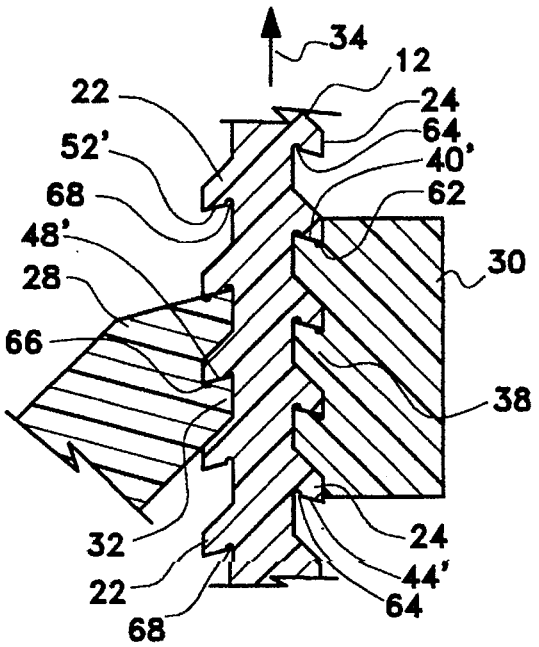
FIG.3

CABLE TIE HAVING ENHANCED LOCKING ENGAGEMENT BETWEEN TEETH ON ABUTMENT WALL AND RATCHET TEETH ON TONGUE

BACKGROUND OF THE INVENTION

The present invention pertains to a tie that is useful for forming a loop for retaining a bundle of elongated articles, such as cables. Such a tie is commonly known as a cable tie One type of tie includes an elongated tongue with two ends and two broad sides, a locking head at one end of the tongue, a tip at the other end of the tongue, a first set of ratchet teeth extending along one broad side of the tongue and a second set of ratchet teeth extending along the other broad side of the tongue, wherein the locking head has sides defining an opening for receiving the tip of the tongue, the sides including a movable pawl that is hinged at one side of the opening and an abutment surface that is across the opening from the pawl, wherein the pawl has at least one pawl tooth disposed for engaging the first set of ratchet teeth when the tip of the tongue has been inserted through the opening with the first set of ratchet teeth facing the pawl, wherein the pawl, when the at least one pawl tooth is so engaged, is movable toward the abutment surface in response to pressure applied to the tongue in a direction opposite to the direction of insertion in order to force the second set of ratchet teeth against the abutment surface; and wherein at least one tooth is disposed on the abutment surface for engaging the second set of ratchet teeth when the tip of the tongue has been inserted through the opening with the second set of ratchet teeth facing the abutment surface and the side of the tongue including the second set of ratchet teeth is forced against the abutment surface by movement of the pawl. Such a tie is described in U.S. Pat. No. 4,473,524 to Paradis.

SUMMARY OF THE INVENTION

The present invention provides enhanced locking engagement between the at least one tooth on the abutment surface and the second set of ratchet teeth on the tongue.

According to one aspect of the present invention, the tie comprises an elongated tongue with two ends and two broad sides, a locking head at one end of the tongue, a tip at the other end of the tongue, a first set of ratchet teeth extending along one broad side of the tongue and a second set of ratchet teeth extending along the other broad side of the tongue, wherein the locking head has sides defining an opening for receiving the tip of the tongue, the sides including a movable pawl that is hinged at one side of said opening and an abutment surface that is across the opening from the pawl, wherein the pawl has at least one pawl tooth disposed for locking engagement with the set of first ratchet teeth when the tip of the tongue has been inserted through said opening with the first set of ratchet teeth facing the pawl, wherein the pawl, when the at least one pawl tooth is so engaged, is movable toward the abutment surface in response to a pulling force applied to the tongue in a direction opposite to the direction of said insertion in order to force the second set of ratchet teeth against the abutment surface; wherein the abutment surface includes at least one tooth having a locking surface extending toward an apex of the tooth at an angle inclined toward said direction of insertion for locking engagement with the second set of ratchet teeth when the tongue has been inserted through the opening with the second set of ratchet teeth facing the abutment surface and the side of the tongue including the second set of ratchet teeth is forced against the abutment surface by movement of the pawl.

According to another aspect of the present invention, the tie comprises an elongated tongue with two ends and two broad sides, a locking head at one end of the tongue, a tip at the other end of the tongue, a first set of ratchet teeth extending along one broad side of the tongue and a second set of ratchet teeth extending along the other broad side of the tongue, wherein the locking head has sides defining an opening for receiving the tip of the tongue, the sides including a movable pawl that is hinged at one side of said opening and an abutment surface that is across the opening from the pawl, wherein the pawl has at least one pawl tooth disposed for locking engagement with the set of first ratchet teeth when the tip of the tongue has been inserted through said opening with the first set of ratchet teeth facing the pawl, wherein the pawl, when the at least one pawl tooth is so engaged, is movable toward the abutment surface in response to a pulling force applied to the tongue in a direction opposite to the direction of said insertion in order to force the second set of ratchet teeth against the abutment surface; wherein the abutment surface includes at least one tooth having a locking surface extending toward an apex of the tooth for locking engagement with the second set of ratchet teeth when the tongue has been inserted through the opening with the second set of ratchet teeth facing the abutment surface and the side of the tongue including the second set of ratchet teeth is forced against the abutment surface by movement of the pawl; and wherein at least one tooth of the second set of ratchet teeth has a locking surface extending toward an apex of said tooth at an angle inclined away from said direction of insertion for locking engagement with the at least one tooth of the abutment surface when the tongue has been inserted through the opening with the second set of ratchet teeth facing the abutment surface and the side of the tongue including the second set of ratchet teeth is forced against the abutment surface by movement of the pawl.

Both of the above aspects of the present invention are combined in the preferred embodiment.

Additional features of the present invention are described with reference to the detailed description of the preferred embodiments.

BRIEF DESCRIPTION OF THE DRAWING

FIG. 1 is a fragmentary sectional view of one preferred embodiment of a tie according to the present invention.

FIG. 2 is an enlarged sectional view illustrating the engagement of the ratchet teeth on the tongue with the abutment surface teeth and the pawl teeth within the locking head of the tie shown in FIG. 1.

FIG. 3 is an enlarged sectional view illustrating the engagement of the ratchet teeth on the tongue with the abutment surface teeth and the pawl teeth within the locking head of an alternative embodiment of a tie according to the present invention.

DETAILED DESCRIPTION

Referring to FIGS. 1 and 2, a preferred embodiment of the tie 10 of the present invention includes an elongated tongue 12 with two ends and two broad sides 14, 16, a locking head 18 at one end of the tongue, a tip 20 at the other end of the tongue 12, a first set of ratchet teeth 22 extending along one broad side 14 of the tongue 12 and a second set of ratchet teeth 24 extending along the other broad side 16 of the tongue 12. The locking head 18 has sides defining an opening 26 for receiving the tip 20 of the tongue 12. The sides include a movable pawl 28 that is hinged at one side of the opening 26 and an abutment wall 30 that is across the opening 26 from the pawl 28. The pawl 28 has pawl teeth 32 disposed for locking engagement with the set of ratchet teeth 22 when the tip 20 of the tongue 12 has been inserted through the opening 26 with the ratchet teeth 22 facing the pawl 28. When at least one pawl tooth 32 is so engaged, the pawl 28 is movable toward the abutment wall 30 in response to a pulling force applied to the tongue 12 in a direction opposite to the direction of insertion 34 in order to force the tongue 12 against an abutment surface 36 of the abutment wall 30. Teeth 38 are disposed on the abutment surface 36 for engaging the second set of ratchet teeth 24 when the tip 20 of the tongue 12 has been inserted through the opening 26 with the second set of ratchet teeth 24 facing the abutment surface 36 and the side 16 of the tongue 12 including the second set of ratchet teeth 24 is forced against the abutment surface 36 by movement of the pawl 28 in response to a pulling force applied to the tongue 12 in a direction opposite to the direction of insertion 34.

Each of the abutment surface teeth 38 has a locking surface 40 extending toward an apex 42 of the tooth 38 at an angle inclined toward the direction of insertion 34 for locking engagement with a tooth of the second set of ratchet teeth 24 when the tongue 12 has been inserted through the opening 26 with the second set of ratchet teeth 34 facing the abutment surface 36 and the side 16 of the tongue 12 including the second set of ratchet teeth 24 is forced against the abutment surface 36 by movement of the pawl 28 in response to a pulling force applied to the tongue 12 in a direction opposite to the direction of insertion 34.

Each of the second set of ratchet teeth 24 has a locking surface 44 extending toward an apex 46 of the tooth 24 at an angle inclined away from the direction of insertion for locking engagement with a tooth 38 of the abutment surface 36 when the tongue 12 has been inserted through the opening 26 with the second set of ratchet teeth 24 facing the abutment surface 36 and the side 16 of the tongue 12 including the second set of ratchet teeth 24 is forced against the abutment surface 36 by movement of the pawl 28. The angle of inclination of the locking surface 40 of each tooth 38 on the abutment surface 36 is the same as the angle of inclination of the locking surface 44 of each of the second set of ratchet teeth 24.

Each pawl tooth 32 has a locking surface 48 extending toward an apex 50 of the tooth 32 at an angle inclined toward the direction of insertion 34 for locking engagement with a tooth of the first set of ratchet teeth 22 when the tongue 12 has been inserted through the opening 26 with the first set of ratchet teeth 22 facing the pawl 28. The angle of inclination of the locking surface 48 of the pawl tooth is defined as the angle of inclination of the locking surface 48 with respect to the direction of insertion 34 when the pawl teeth 32 are in locking engagement with the set of ratchet teeth 22 and the pawl 28 has moved to force the tongue 12 against the abutment surface 36.

Each of the first set of ratchet teeth 22 has a locking surface 52 extending toward an apex 54 of the tooth 22 at an angle inclined away from the direction of insertion 34 for locking engagement with a pawl tooth 32 when the tongue 12 has been inserted through the opening 26 with the set of ratchet teeth 22 facing the pawl 28. The angle of inclination of the locking surface 48 of each pawl tooth 32 is the same as the angle of inclination of the locking surface 52 of each of the first set of ratchet teeth 22.

The side 58 of the pawl 28 including the teeth 32 converges toward the opposite side 60 of the pawl 28 in the direction of insertion 34 to ease the removal of the tie from the mold when the tie 10 is made by injection molding. The abutment surface 36 also converges toward the opposite side 60 of the pawl 28 in the direction of insertion 34 to further ease the removal of the tie from the mold when the tie 10 is made by injection molding.

Preferably, ties 10 according to the present invention are made by injection molding plastic material into a mold defining cavities for forming the ties 10.

In an alternative preferred embodiment shown in FIG. 3, there are notches 62, 64, 66, 68 adjacent the respective locking surfaces 40', 44', 48', 52' of at least some of the abutment surface teeth 38, the second set of ratchet teeth 24, the pawl teeth 28 and/or the first set of ratchet teeth 22. Such locking surfaces 40', 44', 48', 52' do not extend into such notches 62, 64, 66, 68. A locking surface is only that portion a surface that contacts another surface for locking the tongue 12 in the locking head 18. Except for such notches 62, 64, 66, 68, the embodiment of FIG. 3 is the same as the embodiment of FIGS. 1 and 2.

In other alternative embodiments (not shown), (a) there is only one tooth on the abutment surface, with such tooth being inclined at an angle toward the direction of insertion for locking engagement with a tooth of the second set of ratchet teeth; (b) less than all of the second set of ratchet teeth are inclined at an angle away from the direction of insertion for locking engagement with a tooth on the abutment surface; (c) there is only one pawl tooth, with such tooth being inclined at an angle toward the direction of insertion for locking engagement with a tooth of the first set of ratchet teeth; and/or (d) less than all of the first set of ratchet teeth are inclined at an angle away from the direction of insertion for locking engagement with a pawl tooth.

The features of at least one pawl tooth being inclined at an angle toward the direction of insertion for locking engagement with a tooth of the first set of ratchet teeth; and at least one of the first set of ratchet teeth being inclined at an angle away from the direction of insertion for locking engagement with a pawl tooth in a tie in which the side of the pawl including the pawl teeth converges toward the opposite side of the pawl in the direction of insertion, are the subject of U.S. patent application Ser. No. 08/580,657 filed by applicants on even date herewith, entitled "Cable Tie Having Enhanced Locking Engagement Between Pawl Teeth And Ratchet Teeth On Tongue".

The advantages specifically stated herein do not necessarily apply to every conceivable embodiment of the present invention. Further, such stated advantages of the present invention are only examples and should not be construed as the only advantages of the present invention.

While the above description contains many specificities, these should not be construed as limitations on the scope of the present invention, but rather as exemplifications of the preferred embodiments described herein. Other variations are possible and the scope of the present invention should be determined not by the embodiments described herein but rather by the claims and their legal equivalents.

We claim:

1. A tie comprising an elongated tongue with two-ends and two broad sides, a locking head at one end of the tongue, a tip at the other end of the tongue, a first set of ratchet teeth extending along one broad side of the tongue and a second set of ratchet teeth extending along the other broad side of the tongue, wherein the locking head has sides defining an opening for receiving the tip of the tongue, the sides including a movable pawl that is hinged at one side of said opening and an abutment surface that is across the opening from the pawl, wherein the pawl has at least one pawl tooth disposed for locking engagement with the set of first ratchet teeth when the tip of the tongue has been inserted through said opening with the first set of ratchet teeth facing the pawl, wherein the pawl, when the at least one pawl tooth is so engaged, is movable toward the abutment surface in response to a pulling force applied to the tongue in a direction opposite to the direction of said insertion in order to force the second set of ratchet teeth against the abutment surface;

wherein the abutment surface includes a plurality of teeth having a locking surface extending toward an apex of the tooth at an angle inclined toward said direction of insertion for looking engagement with the second set of ratchet teeth when the tongue has been inserted through the opening with the second set of ratchet teeth facing the abutment surface and the side of the tongue including the second set of ratchet teeth is forced against the abutment surface by movement of the pawl.

2. A tie comprising an elongated tongue with two ends and two broad sides, a locking head at one end of the tongue, a tip at the other end of the tongue, a first set of ratchet teeth extending along one broad side of the tongue and a second set of ratchet teeth extending along the other broad side of the tongue, wherein the locking head has sides defining an opening for receiving the tip of the tongue, the sides including a movable pawl that is hinged at one side of said opening and an abutment surface that is across the opening from the pawl, wherein the pawl has at least one pawl tooth disposed for locking engagement with the set of first ratchet teeth when the tip of the tongue has been inserted through said opening with the first set of ratchet teeth facing the pawl, wherein the pawl, when the at least one pawl tooth is so engaged, is movable toward the abutment surface in response to a pulling force applied to the tongue in a direction opposite to the direction of said insertion in order to force the second set of ratchet teeth against the abutment surface;

wherein the abutment surface includes a plurality of teeth having a locking surface extending toward an apex of the tooth for locking engagement with the second set of ratchet teeth when the tongue has been inserted through the opening with the second set of ratchet teeth facing the abutment surface and the side of the tongue including the second set of ratchet teeth is forced against the abutment surface by movement of the pawl; and wherein at least one tooth of the second set of ratchet teeth has a locking surface extending toward an apex of said tooth at an angle inclined away from said direction of insertion for locking engagement with the plurality of teeth of the abutment surface when the tongue has been inserted through the opening with the second set of ratchet teeth facing the abutment surface and the side of the tongue including the second set of ratchet teeth is forced against the abutment surface by movement of the pawl.

3. A tie comprising an elongated tongue with two ends and two broad sides, a locking head at one end of the tongue, a tip at the other end of the tongue, a first set of ratchet teeth extending along one broad side of the tongue and a second set of ratchet teeth extending along the other broad side of the tongue wherein the locking head has sides defining an opening for receiving the tip of the tongue, the sides including a movable pawl that is hinged at one side of said opening and an abutment surface that is across the opening from the pawl, wherein the pawl has at least one pawl tooth disposed for locking engagement with the set of first ratchet teeth when the tip of the tongue has been inserted through said opening with the first set of ratchet teeth facing the pawl, wherein the pawl when the at least one pawl tooth is so engaged, is movable toward the abutment surface in response to a pulling force applied to the tongue in a direction opposite to the direction of said insertion in order to force the second set of ratchet teeth against the abutment surface;

wherein the abutment surface includes at least one tooth having a locking surface extending toward an apex of the tooth for locking engagement with the second set of ratchet teeth when the tongue has been inserted through the opening with the second set of ratchet teeth facing the abutment surface and the side of the tongue including the second set of ratchet teeth is forced against the abutment surface by movement of the pawl;

wherein at least one tooth of the second set of ratchet teeth has a locking surface extending toward an apex of said tooth at an angle inclined away from said direction of insertion for locking engagement with the at least one tooth of the abutment surface when the tongue has been inserted through the opening with the second set of ratchet teeth facing the abutment surface and the side of the toddle including the second set of ratchet teeth is forced against the abutment surface by movement of the pawl; and wherein the locking surface of said at least one tooth of the abutment surface extends toward said apex of said tooth at an angle inclined toward said direction of insertion for said locking engagement with the second set of ratchet teeth.

4. A tie according to claim 3, wherein the angle of inclination of the locking surface of each said at least one tooth of the abutment surface is the same as the angle of inclination of the locking surface of each said at least one tooth of the second set of ratchet teeth.

* * * * *

UNITED STATES PATENT AND TRADEMARK OFFICE

CERTIFICATE OF CORRECTION

PATENT NO. : 5,664,294

DATED : September 9, 1997

INVENTOR(S) : Soren Christian Sorensen et al.

It is certified that error appears in the above-indentified patent and that said Letters Patent is hereby corrected as shown below:

Column 6, line 40, "toddle" should read --tongue--.

Signed and Sealed this

Twenty-first Day of July, 1998

Bruce Lehman

*Attest:*

BRUCE LEHMAN

*Attesting Officer*

*Commissioner of Patents and Trademarks*